United States Patent [19]

Brooks

[11] Patent Number: 4,832,401

[45] Date of Patent: May 23, 1989

[54] APPARATUS AND METHOD OF A SEAT WITH A FLOATING LUMBAR

[75] Inventor: Vincent L. Brooks, Ferndale, Mich.

[73] Assignee: General Motors Corporation, Detroit, Mich.

[21] Appl. No.: 176,553

[22] Filed: Apr. 1, 1988

[51] Int. Cl.[4] ..... A47C 3/00

[52] U.S. Cl. ..... 297/284; 297/307; 297/309

[58] Field of Search ..... 297/284, 307, 309, 320

[56] References Cited

U.S. PATENT DOCUMENTS

| | | | |
|---|---|---|---|
| 1,182,854 | 5/1916 | Poler | 297/284 |
| 1,929,024 | 10/1933 | Ingle | 297/307 |
| 2,009,024 | 7/1935 | Salmons | 297/309 |
| 2,991,124 | 7/1961 | Schwarz | 297/284 |
| 3,106,423 | 10/1963 | Schwarz | 297/284 |
| 3,137,524 | 6/1964 | Chancellor | 297/284 |
| 3,163,466 | 12/1964 | Radke et al. | 297/320 X |
| 3,219,386 | 11/1965 | Simons | 297/309 |
| 4,634,176 | 1/1987 | Scott | 297/284 |
| 4,676,550 | 6/1987 | De Mevergnies | 297/284 |

*Primary Examiner*—Francis K. Zugel

*Attorney, Agent, or Firm*—Ernest E. Helms

[57] ABSTRACT

The present invention provides an apparatus and method of utilization thereof of a vehicle seat wherein the position of a lumbar support on the seat back is adjusted automatically in response to the deflection of the femur seating surface of the seat cushion. The present invention is advantageous in that the lumbar support is placed in a position generally constant with respect to the lower portion of the vehicle seat occupant's back, regardless of the weight of the vehicle seat occupant.

4 Claims, 1 Drawing Sheet

APPARATUS AND METHOD OF A SEAT WITH A FLOATING LUMBAR

FIELD OF THE INVENTION

The field of the present invention is that of automotive vehicle seats. More particularly, the field of the present invention is that of automotive vehicle seats with lumbar supports.

DISCLOSURE STATEMENT

It is known to provide automotive vehicle seats with a lumbar support to enhance the seat occupant's comfort. The lumbar support is usually contoured to mate with the small of the occupants back. The optimum location of the lumbar support in relationship to the lowest part of the vehicle seat occupant's body within the seat while sitting is fairly constant for a wide range of vehicle seat occupants. However, when the vehicle seat is occupied by an occupant of a higher weight, the weight of the occupant will position his or her body lower in the seat such that the lumbar support may contact the vehicle seat occupant's body at a position higher than is optimum. In a similar manner, very light vehicle seat occupants may find that the location of the lumbar support along their lower back may be lower than the optimum since the location has been designed to mate with a vehicle seat occupant's back whose weight is closer to the norm of the expected vehicle seat occupants.

Even when the vehicle seat is utilized by an occupant whose weight is closer to the norm of all vehicle seat occupants, the lumbar support may seem to be somewhat out of place when the vehicle is utilized on a rough road wherein the occupants body may tend to move up and down with respect to the floor of the vehicle.

SUMMARY OF THE INVENTION

To overcome the above noted problems, the present invention is brought forth. The present invention in a preferred embodiment provides a lumbar support which has means of connection with a femur seat cushion of the seat. The femur seat cushion is deflectable with respect to the seat cushion frame of the seat. The lumbar support is also slidably and resiliently mounted to the seat back. The location of the lumbar support with respect to the seat back is a function of the deflection of the femur seat cushion with respect to the seat cushion frame. Therefore, the lumbar support exhibits a tendency to be closer to the optimum position in relationship to vehicle seat occupant's back regardless of the vehicle seat occupant's weight or regardless of any movement of the vehicle seat occupant within the seat due to the vehicle traversing over rough terrain. The above adjustment is achieved without any expenditure of effort by the vehicle seat occupant.

It is the object of the present invention to provide a vehicle seat apparatus and method of utilization thereof wherein the lumbar support of the vehicle seat is automatically adjusted with respect to the vehicle seat back in relation to the deflection of the vehicle seat cushion.

It is an object of the present invention to provide a vehicle seat, the seat including a seat cushion frame extending generally horizontally, a femur seating surface connected with and deflectable with respect to the cushion frame, a seat back extending generally vertically from the seat cushion frame, and a lumbar support providing a surface of support along a lower portion of the seat back and being resiliently slidably mounted thereto with means of connection with the femur seating surface whereby the location of the lumbar with respect to the seat back is a function of the deflection of the femur seating surface.

It is an object of the present invention to provide a vehicle seat, the seat in combination comprising a seat cushion frame extending generally horizontally, a femur seating surface connected with and deflectable with respect to the seat cushion frame, a longitudinally slotted seat back extending generally vertically from the seat cushion frame, and a lumbar support providing a surface of support along a lower portion of the seat back, the lumbar support being slidably mounted within the slots of the seat back frame and being pivotal thereto with a flexible means of connection with the seating surface and the lumbar support being spring biased to an upper position along the seat back frame slots whereby the location of the lumbar support along the seat back is a function of the deflection of the femur seating surface.

It is an object of the present invention to provide a method of automatically adjusting the location of a lumbar support on a vehicle seat along the seat back of the seat, the method including extending a generally vertically seat back from a seat cushion frame which extends generally horizontally, connecting with the seat cushion frame a femur seating surface which can be deflected with respect to the seat cushion frame, and slidably and resiliently connecting the lumbar support with the seat back, connecting the lumbar support with the femur seating surface, and deflecting the femur seating surface with respect to the seat cushion frame whereby the location of the lumbar support along the seat back is automatically adjusted in response to the deflection of the femur seating surface.

Other objects, desires and advantages of the present invention can become more apparent to those skilled in the art as the nature of the invention is better understood from the accompanying drawings and a detailed description.

DETAILED DESCRIPTION OF THE DRAWINGS

Figure 1:
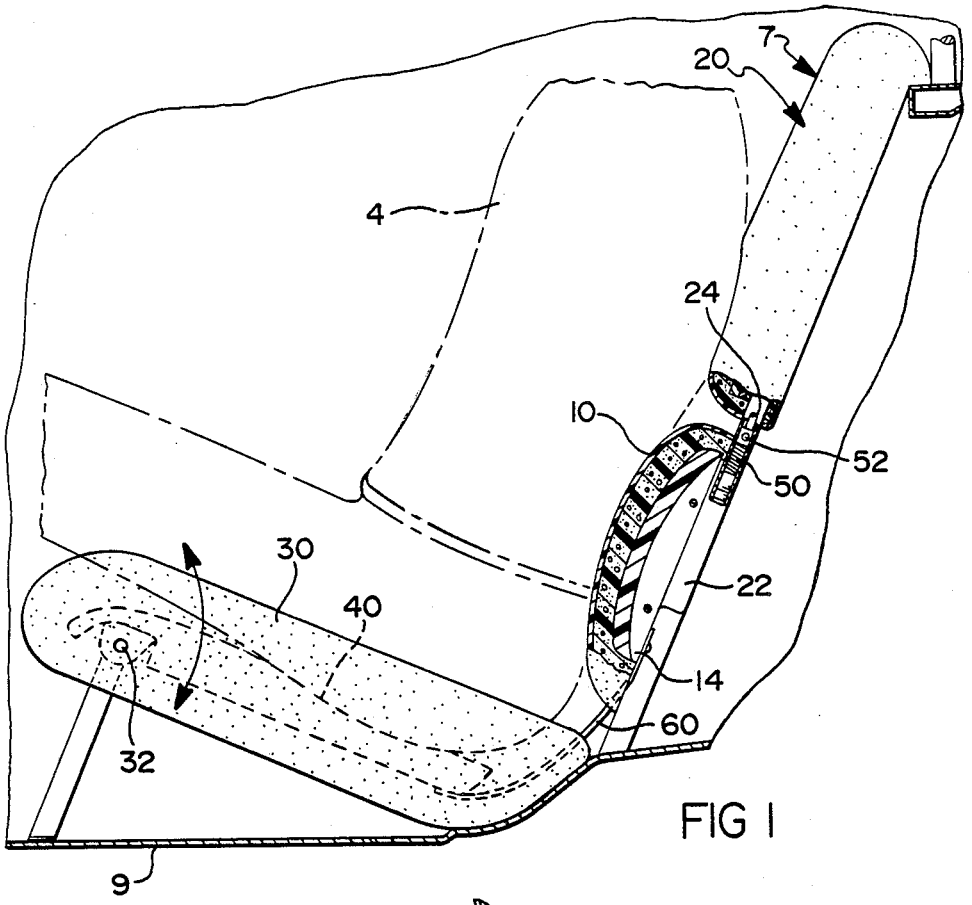
FIG. 1 is a sectional view mainly in side elevation of a preferred embodiment vehicle seat of the present invention.
Figure 2:
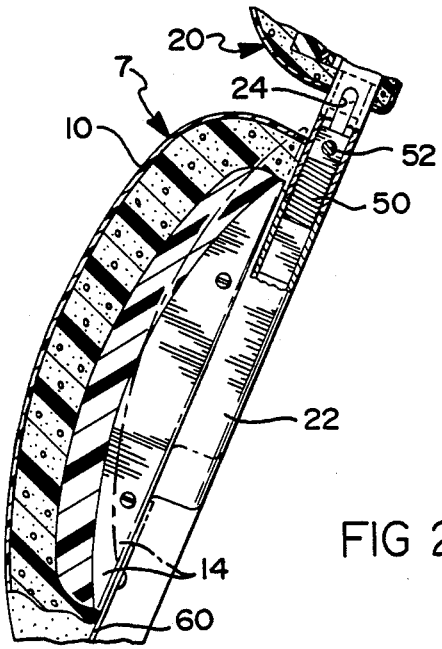
FIG. 2 is an enlargement of a portion of vehicle seat illustrated in FIG. 1.

Referring to FIGS. 1 and 2, the vehicle seat 7 of the present invention has a seat cushion frame 30 which connects the vehicle seat 7 with the floor 9 of the vehicle. The seat cushion frame 30 extends generally horizontally although it is inclined.

Pivotally connected towards front end 32 of the cushion frame 30 is a femur seating surface 40. The femur seating surface 40 provides a surface of contact for the hip and thigh portions of the vehicle seat occupant's body and is usually covered with appropriate padding material. The femur seating surface 40 by virtue of the pivotal connection with the cushion frame 30 is deflectable with respect to the seat cushion frame 30. However, alternative embodiments (not shown) allow for deflection of the femur seating surface without pivotal movement and such pivotal action is not a requirement of this invention.

Joined to the seat cushion frame 30 via the floor 9 and extending generally vertically therefrom is the seat back 20. The seat back has at least two generally parallel spaced apart frame members 22 (only one shown). Each frame member 22 has a longitudinal slot 24.

Resiliently, slidably and pivotally connected to the seat back frame is a lumbar support 10. The location of the lumbar support 10 is generally along the lower portion of the seat back 20. The lumbar support 10 is urged to a generally upper position by a spring 50, which biases a rod 52. The rod 52 provides a pivotal axis of the lumbar support 10 with respect to the vehicle seat back 20. The rod 52 as can be seen is entrapped within the slot 24 of the cushion support back frame member 22.

The femur seating surface 40 has connected thereto a flexible strap 60 providing the means of connection between the femur seating surface 40 and a lower end 14 of the lumbar support. In some applications, it may be desirable to have a generally transverse (of the vehicle) rod connected adjacent the intersection of the seat back frame 22 and the seat cushion frame 30 to position the strap 60 outward (rearward) from the position of the seat occupants hips.

When the vehicle seat 7 is unoccupied, the lumbar support 10 will be at an uppermost position. Upon the seating of the seat occupant 4, the femur seating surface 40 will deflect downward basically as a function of the weight of the seat occupant 4. The above will cause the lumbar support 10 to be pulled downward against the action of spring 50 to keep the position of the lumbar support 10 with respect to the curvature of the vehicle seat occupant's back in a generally constant position.

It will be apparent to those skilled in the art that the position of the lumbar support 10 will be function of the occupant's weight, and the spring constant of the spring 50. If desired the spring constant can be modified to give a nonlinear function of weight to deflection.

The present invention provides a method of automatically adjusting the location of a lumbar support 10 on a vehicle seat 7 along the seat back 20 of the seat 7, the method including the following steps:

1. Extending generally vertically a seat back 20 from a seat cushion frame 30 which extends generally horizontally.

2. Connecting with the seat cushion frame 30 a femur seating surface 40 which can be deflected with respect to the seat cushion frame 30. 3. Slidably and resiliently connecting the lumbar support 10 with the seat back 20.

4. Connecting 60 the lumbar support 10 with the femur seating surface 40.

5. Deflecting the femur seating surface 40 with respect to the seat cushion frame 30 whereby the location of the lumbar support 10 along the seat back 20 is automatically adjusted in response to the deflection of the femur seating surface 40.

While an embodiment of the present invention has been explained, it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A vehicle seat, said seat in combination comprising:
- a seat cushion frame extending generally horizontally;
- a femur seating surface connected with and deflectable with respect to said cushion frame;
- a seat back extending generally vertically from said seat cushion frame; and
- a lumbar support providing a surface of support along a lower portion of said seat back and being resiliently slidably mounted thereto and with a means of flexible strap connection with said femur seating surface whereby the location of said lumbar with respect to said seat back is a function of the deflection of said femur seating surface.

2. A vehicle seat as described in claim no. 1 wherein said seat back has a longitudinal slot and said lumbar support is pivotally mounted within said slots and is spring biased to an upper position.

3. A vehicle seat, said seat in combination comprising:
- a seat cushion frame extending generally horizontally;
- a femur seating surface connected with and deflectable with respect to said seat cushion frame; a longitudinally slotted seat back extending generally vertically from said seat cushion frame; and
- a lumbar support providing a surface of support along a lower portion of said seat back, said lumbar support being slidably mounted within said slots of said seat back frame and being pivotal thereto with a flexible strap means of connection with said seating surface and said lumbar support being spring biased to an upper position along said seat back frame slots whereby the location of said lumbar support along said seat back is a function of the deflection of said femur seating surface.

4. A method of automatically adjusting the location of a lumbar support on a vehicle seat along the seat back of said seat, said method in combination comprising:
- extending generally vertically a seat back from a seat cushion frame which extends generally horizontally;
- connecting with said seat cushion frame a femur seating surface which can be deflected with respect to said seat cushion frame;
- slidably and resiliently connecting said lumbar support with said seat back;
- connecting flexible strap means between said lumbar support and said femur seating surface; and
- deflecting said femur seating surface with respect to said seat cushion frame whereby the location of said lumbar support along said seat back is automatically adjusted in response to said deflection of said femur seating surface.

* * * * *